US006716775B1

(12) United States Patent
Dischler et al.

(10) Patent No.: US 6,716,775 B1
(45) **Date of Patent: *Apr. 6, 2004**

(54) RANGE-DYED FACE FINISHED FABRICS EXHIBITING NON-DIRECTIONAL SURFACE FIBER CHARACTERISTICS

(75) Inventors: Louis Dischler, Spartanburg, SC (US); Wesley M. Drexler, Spartanburg, SC (US); Scott W. Efird, Moore, SC (US); Dale Robert Williams, Greer, SC (US)

(73) Assignee: Milliken & Company, Spartenburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,951

(22) Filed: May 12, 2000

(51) Int. Cl.[7] ..... D04H 1/00; D04H 3/00

(52) U.S. Cl. ..... 442/59; 442/340; 442/341; 442/344; 442/361; 442/362; 442/363; 442/364; 442/365; 442/401; 442/409; 442/411; 442/415; 28/160

(58) Field of Search ..... 28/160; 442/340, 442/341, 344, 361–365, 401, 409, 411, 415

(56) References Cited

U.S. PATENT DOCUMENTS

| | | | | |
|---|---|---|---|---|
| 2,107,528 A | | 2/1938 | Feinberg | 26/28 |
| 2,896,304 A | | 7/1959 | Peroni | 28/72 |
| 2,926,414 A | | 3/1960 | Weiss et al. | 26/69 |
| 3,549,398 A | | 12/1970 | Watson | 117/8 |
| 3,650,800 A | | 3/1972 | Reiner | 117/37 |
| 3,894,318 A | | 7/1975 | Ito et al. | 26/28 |
| 3,973,359 A | | 8/1976 | Spencer et al. | 51/75 |
| 3,980,549 A | | 9/1976 | Grutza | 204/16 |
| 4,463,483 A | | 8/1984 | Holm | 26/29 P |
| 4,468,844 A | | 9/1984 | Otto | 26/28 |
| 4,512,065 A | * | 4/1985 | Otto | 26/28 |
| 4,608,128 A | | 8/1986 | Farmer et al. | 204/16 |
| 4,864,150 A | | 9/1989 | Mann et al. | 250/571 |
| 5,473,801 A | | 12/1995 | Straube et al. | 26/33 |
| 5,505,739 A | | 4/1996 | Montesano | 8/102 |
| 5,752,300 A | | 5/1998 | Dischler | 26/28 |
| 5,815,896 A | | 10/1998 | Dischler | 26/28 |
| 6,112,381 A | * | 9/2000 | Dischler et al. | 26/28 |

FOREIGN PATENT DOCUMENTS

| | | |
|---|---|---|
| GB | 2328957 | 3/1999 |
| JP | 58-197366 | 11/1983 |
| WO | WO00/49217 | 8/2000 |

* cited by examiner

*Primary Examiner*—Glenn Caldarola
*Assistant Examiner*—Alexis Wachtel
(74) *Attorney, Agent, or Firm*—Terry T. Moyer; William S. Parks

(57) ABSTRACT

Range-dyed fabrics that possess excellent hand characteristics and simultaneously exhibit substantially nondirectional appearances are provided. Such a combination permits the production and utilization of an extremely comfortable apparel fabric that can be attached to any other similar type of fabric to form a target apparel article without the time-consuming need to align such component fabrics to ensure an overall aesthetic appearance is met for the target apparel article. In general, such a fabric is produced through the initial immobilization of individual fibers within target fabrics and subsequent treatment through abrasion, sanding, or sueding of at least a portion of the target fabric. Such a procedure produces a fabric of short pile height and desirable hand. Upon range-dyeing the target fabric exhibits the extra benefit of nondirectional surface characteristics. The ability to produce such specific fabrics without the need for jet-dyeing thus provides a significant cost advantage to the manufacturer and consumer.

19 Claims, 1 Drawing Sheet

RANGE-DYED FACE FINISHED FABRICS EXHIBITING NON-DIRECTIONAL SURFACE FIBER CHARACTERISTICS

FIELD OF THE INVENTION

The inventive range-dyed fabrics possess excellent hand characteristics and simultaneously exhibit substantially non-directional appearances. Such a combination permits the production and utilization of an extremely comfortable apparel fabric that can be attached to any other similar type of fabric to form a target apparel article without the time-consuming need to align such component fabrics to ensure an overall aesthetic appearance is met for the target apparel article. In general, such a fabric is produced through the initial immobilization of individual fibers within target fabrics and subsequent treatment through abrasion, sanding, or sueding of at least a portion of the target fabric. Such a procedure produces a fabric of short pile height and desirable hand. Upon range-dyeing the target fabric exhibits the extra benefit of nondirectional surface characteristics. The ability to produce such specific fabrics without the need for jet-dyeing thus provides a significant cost advantage to the manufacturer and consumer.

BACKGROUND OF THE PRIOR ART

Materials such as fabrics are characterized by a wide variety of functional and aesthetic characteristics. Of those characteristics, a particularly important feature is fabric surface feel or "hand." The significance of a favorable hand in a fabric is described and explained in U.S. Pat. Nos. 4,918,795 and 4,837,902, both to Dischler, the teachings of which are both entirely incorporated herein by reference.

Favorable hand characteristics of a fabric are usually obtained upon conditioning of prepared textiles (i.e., fabrics which have been de-sized, bleached, mercerized, and dried). Prior methods of prepared-fabric conditioning have included roughening of the finished product with textured rolls or pads. It has now been discovered, surprisingly, that such conditioning would favorably be performed while the target fabric is in its greige state or is unprepared. The conditioning of such fabrics provides heretofore unknown benefits in improvements in overall fabric strength, and the like (as discussed in greater detail below). Of great importance and necessity then within the textile treatment industry is a procedure through which greige or unfinished fabrics can be treated and subsequently finished which provides desirable hand to the target textile and does not adversely impact the ability for dyeing, decorating, and the like, the textile at a future point in time. Such processes have not been taught nor fairly suggested within the pertinent art. Thus, there is no prior teaching nor fair suggestion within the pertinent art which has accorded highly effective and easily duplicated textile hand improvements to greige goods and unfinished textiles.

In the textile industry, it is known to finish woven fabrics by abrading one or both surfaces of the fabric using sandpaper or a similarly abrasive material to cut and raise the fibers of the constituent yarns in the fabric. Through such a treatment, a resultant fabric is obtained generally exhibiting a closely raised nap producing a soft, smooth surface texture resembling suede leather. This operation, commonly referred to as sueding or sanding, is conventionally performed by a specialized fabric sueding machine wherein the fabric is passed under tension over one or more finishing rolls, covered with sandpaper or a similarly abrasive material, which are rotated at a differential speed relative to the moving fabric web. Such machines are described in U.S. Pat. Nos. 5,752,300 to Dischler, and 3,973,359 to Spencer, both hereby entirely incorporated by reference.

Another well known technique for enhancing aesthetic and performance characteristics of a fabric through the same type of surface-raising treatment is napping. Such a treatment provides a fabric exhibiting a softer hand, improved drapeability, greater fabric thickness, and better overall durability. Napping machinery generally utilizes rotatably driven cylinders including peripheral wire teeth, such as, normally, card clothing, over which the fabric travels under a certain amount of tension.

During a napping treatment the individual fibers are ideally pulled from the fabric body in contrast to sueding which ideally cuts the individual fibers. Sueding, however, presents some disadvantages including the fact that a certain amount of napping occurs simultaneously. Grit particles engage the surface fibers of the target fabric and inevitably pull them from the fabric body resulting in a relatively long pile. Such a long pile traps air at the surface of the fabric creating an insulating-type effect which thereby produces a warm feeling against the wearer's skin. Such an insulating effect is highly undesirable, particularly for apparel intended for summer wear. Upon utilization of strong synthetic fibers (i.e., nylon or polyester), this tendency for fibers to be pulled from the surface of the fabric is accentuated. More tension would thus be required to cut through such strong fibers (as compared to the force necessary to cut weaker ones) and the stronger fibers then are pulled more easily from the yarn. Upon engagement by an abrasive grit particle, sufficient tension to pull rather than easily cut the fibers is accorded. Pilling is thus more noticeable with strong synthetic fibers and where a long pile is created (and thus highly disadvantageous) because entanglement between adjacent fibers is more likely to occur, thereby resulting in highly objectionable and unwanted pills on the fabric surface.

Methods have been utilized in the past on prepared fabrics to produce a short pile in order to decrease the potential for pilling. These have included the use of sand paper with very fine grit, brush rolls with grit particles embedded in soft nylon bristles, and even blocks of pumice stone mounted upon oscillating bars. However, the fine grit sandpaper degrades easily and rapidly due to the loss of grit particles and the build-up of debris between the remaining particles. Furthermore, the target fibers are not cut in this fashion as much as they are generally eroded. Thus, fine grit sandpaper does not provide an effective process of replacing the sueding techniques mentioned above. Soft nylon bristles also appear to merely erode the fibers away than cut and also is highly inefficient because of the light pressure such devices apply to the target fabric. Pumice stone, being very soft, is itself subject to damage in such operations and also facilitates unwanted build-up of fibrous debris within the treatment surface of the stone. Undesirable wet procedures are generally necessary to produce any effective sueding results for pumice stone and fine grit sandpaper treatments.

Another disadvantage of prior napping and/or sueding treatments concerns the situation where fill yarns are exposed on the surface of the target fabric. Being perpendicular to the action of the napping and/or sueding, such treatments tend to act primarily upon these exposed yarns rather than the warp yarns. Weaving economy generally dictates that the target fabric would be more heavily constructed in the warp direction and thus it would be highly advantageous for sueding to act primarily on such warp yarns since those yarns exhibit more strength to relinquish during the abrasion procedure.

As noted above, one of the most unpleasant and unsightly phenomena produced through the utilization of strong synthetic fibers within fabrics is pilling. This term is generally accepted to mean the formation of small balls of fiber which are created on the textile surface by the entanglement of free fiber ends. Such fibers which hold the pills to the base fabric do not break off because the synthetic fibers (such as polyester) exhibit a higher flex strength than natural fibers and thus small balls of twisted and entangled fiber cling to the fabric surface.

A number of procedures have been developed to counter this undesirable pilling effect within the textile industry. For instance, polyester fibers have been produced with low molecular weights or low solution viscosities in order to reduce the strength of the fibers resulting in fiber ends and nascent pills which more readily break off from the fabric surface (just as with natural fibers). However, such a reduction in strength (by about 40% from standard polyester fibers) leaves them highly susceptible to damage during further processing thus prohibiting processing on ring or rotor-spinning frames at the same speeds and with the same efficiencies as normal types of natural fibers (such as cotton). A further method to control pilling concerns the chemical weakening of fibers within woven fabrics. This is accomplished through the application of super-heated steam or aqueous solutions of acids, ammonia, ammonia vapors, or amines. In such an instance, however, the entire fabric strength is sacrificed with no concomitant enhancement of hand. Furthermore, the potential for fabric defects (such as stains and uneven dyeing) is increased. An additional method is to utilize yarns having high twist. However, such resultant fabrics exhibit a harsh hand and the internal compression generated by the twist of the individual fibers makes it very difficult to properly de-size, mercerize, and dye fabrics comprising such high-twist yarns. It would thus be highly desirable to obtain substantial reduction in pilling for fabrics comprising strong synthetic fibers without recourse to the above processes and methods. Unfortunately, the prior art has not accorded such an improvement with a simultaneous improvement in hand of the fabric. The present invention provides such a hand improvement method to unfinished fabrics. Such a method also substantially eliminates pilling in fabrics comprised of synthetic fibers simultaneously while providing the aforementioned improvements of the hand of the target fabric.

One further characteristic permitted with the utilization of such a face finishing method is a non-directional pile surface of the sueded fabric. Generally, sueding typically produces a pile that is pressed down preferentially in one direction by contact with the surfaces of nip and idler rolls during subsequent dyeing and finishing. The resultant directionality of the pile results in a variation in the perceived shade when then fabric is observed along the warp in the forward direction as compared to the rearward direction. Such a discrepancy in appearance reduces the efficiency of fabric utilization when the fabric is cut to ultimately produce garments, and the like, since directionality of appearance must be considered to avoid mismatching of shade between panels in the finished product. Such a problem is encountered even when pile and counter-pile treatment rollers are utilized to create an equal amount of abrasive treatment in each direction.

Jet-dyeing provides one method of achieving such desirable non-directional pile characteristics. However, in such a procedure the fabric is dyed in rope form within a dye liquor which is kept at a high temperature and a pressure above 1 atmosphere. As the target fabric is subjected randomly to directed forces, the pile does not receive a preferential lay and a non-directional fabric may thus be obtained. The serious drawback and thus major disadvantage to jet-dyeing is its higher cost as compared with range dyeing (wherein a fabric web is dyed in an unfolded, untwisted, and/or uncreased position), as well as the ease with which creases and other defects may be produced. A method which permits range dyeing of fabric as the sole means to provide color to the target fabric as well as production of a fabric pile exhibiting substantially non-directional appearance characteristics would therefore be of great benefit to the apparel, garment, and the like, industries. Such a range-dyed, non-directional fabric pile has heretofore not been disclosed nor fairly suggested within the pertinent prior art.

OBJECTS OF THE INVENTION

The primary object of this invention is therefore to provide improved sueded hand to greige or unprepared fabrics while also retaining a balanced strength over the entire fabric structure. It is thus an additional advantage of this invention to provide such a method that is highly cost-effective and enhances subsequent fabric processing such as de-sizing, mercerization, dyeing, and the like. Another object of this invention is to provide a method of improving the hand of unfinished fabrics comprising synthetic fibers which simultaneously substantially eliminates pilling on the fabric surface. Yet another advantage of this invention is to provide a sueded cotton/polyester blended fabric wherein the sueded surface is dominated by relatively soft polyester fibers. Still a further object of this invention is to provide a sueded, range-dyed fabric that exhibits substantially no directionality of its pile surface. These and other advantages will be in part apparent and in part pointed out below.

In order to accomplish these and other objects, the present invention thus encompasses a range-dyed fabric having a first face and a second face, wherein at least one of said first face and said second face have been mechanically finished, and wherein said mechanically finished face exhibits a directionality measurement in appearance and under a light source selected from the group consisting of incandescent, fluorescent, and simulated sunlight, at most 1.75 as measured at both 20° and 45° detection angles in relation to a gloss angle.

The term "mechanically finished" is discussed more fully below but basically comprises any standard fabric treatment method which imparts a noticeable hand improvement to the target fabric as compared with the same, untreated fabric. Thus, sanding, sueding, napping, and the like, all fall into this category. The inventive fabric thus must exhibit a specific directionality measurement on its mechanically finished portion at two specific detection angles. Again, these parameters and measurements are discussed in greater detail below.

DESCRIPTION OF THE INVENTION

In order to improve the hand of fabrics in a manner which is consistent with warm weather wear, the constituent fibers must be treated in a manner which provides a consistently short pile, so that a stagnant layer of insulating air is not trapped at the fabric surface. Also, to produce a pile surface of a range-dyed fabric which exhibits substantially no directional appearance characteristics of its pile surface fibers, a method which ensures little or no specific directional treatments of such individual fibers will occur during a sueding (i.e., napping, sanding, and the like) treatment. To provide such advantageous characteristics on target fabrics, it has now been found that, by first immobilizing the fibers constituting the fabric with a temporary coating, followed by an abrasive treatment of the fabric surface, and then removal of the temporary coating, the desired fabric of unique aesthetic and practical characteristics (such as non-directionality in the appearance of the pile fibers) is obtained. Compared to a fabric which has been sanded or napped, a fabric treated by the present inventive method is cooler to the touch, smoother to the hand, dramatically more resistant to pilling, and exhibits substantially no directionality of appearance of the pile fibers, particularly upon range-dyeing of the target fabric. To understand how these advantageous characteristics are obtained, it is useful to compare the action of card wire on a film of polyester (e.g., Mylar™) to the action of the wire on a polyester fabric. When card wire is dragged across a Mylar™ film under pressure, many small scratches are seen to develop in the surface, due to the combination of high pressure at the wire tip combined with the high hardness of the wire relative to polyester. When the wire is similarly dragged across the polyester fabric, scratches are generally not found since the motion of the fibers relative to each other allows the stresses to be dissipated before abrasive wear occurs. Also, the interaction of wire and fiber typically tensions the fiber and draws it away from the yarn surface. When the fabric subsumes the characteristics of a film, scratching of the fiber surface does then occur, and pulling out of fibers from the yarn is prevented. Thus, the fabric is transformed into film (or composite), abraded, and then transformed back into a fabric. What would be linear scratches on a film appear as nicks of various sizes on the surface fibers, including nicks which entirely cut through some of the fibers. The cut fiber ends will be released during subsequent processing (e.g., de-sizing) to form a pile which is uniformly short. This substantial uniformity in appearance is due to the substantial uniformity of treatment of each individual pile fiber. Short fibers resist forming pills because the number of adjacent fibers available for entanglement is limited to those few within reach of each other. "Nicks" on these fibers serve as stress risers, allowing the fiber to break off during the kind of bending that occurs during pill formation. Since only the surface fibers have been so weakened, the bulk of the fabric strength has been retained as compared to chemical treatments, which necessarily weaken the entire fabric structure. This substantial uniformity thus provides the highly desired non-directional appearance characteristics within the final range-dyed target fabric. Such an inventive fabric can thus provide a more efficient and cost-effective product since jet-dyeing is relatively expensive and non-directional characteristics facilitate further construction of apparel, and the like, without the need to determine the proper alignment for each component fabric for aesthetic purposes.

The term "nicking" basically encompasses the creation of cuts at random locations on individual fibers thus providing stress risers on the individual fibers. The immobilization of these fibers thus increases frictional contact between the individual fibers and prevents movement of the fibers during the sanding, abrading, or napping procedure. The abrading, sanding, or napping of non-immobilized fibers which move during treatment can result in the relative motion of the fibers and the pulling out of long fibers as the fibers interact with the abrasive or napping media. Such a process does provide improvements in the hand of such fabrics; however, the filling strength of the fabric may be sacrificed and the ability of the fabric to trap unwanted air (thus producing a warmer" fabric) is increased. Therefore, the inventive process comprises first immobilizing the surface fibers of a fabric with a temporary coating; second, treating the immobilized surface fibers by abrasion, sanding, or napping in order to cut and "nick" the fibers; and third, removing, in some manner, the temporary coating. It should be noted that the "napping" referred to herein, when used in conjunction with immobilized fabric, does not impart a napped finish to the target fabric, but rather, it imparts cuts and nicks to the immobilized fibers without pulling the immobilized fibers from the target surface (i.e., the resultant fabric does not exhibit a "napped" surface).

The immobilization step thus comprises encapsulating at least the surface fibers (and possibly some or all of the internal fibers of the fabric) in a coating matrix which makes the fibers stationary to the point that the individual fibers are resistant to motion due to the space-filling characteristics of the coating matrix within the interstices between the fibers, as well as the adhesion of adjacent fibers by the coating matrix. A typical coating matrix which imparts immobilization on the surface fibers of a target fabric is size (i.e., starch, polyvinyl alcohol, polyacrylic acid, and the like) which can easily be removed through exposure to water or other type of solvent. Usually, size is added to warp yarns prior to weaving. In accordance with this invention, the size already present in the greige goods to be abraded may be employed for the purpose of immobilization; alternatively, additional size may be coated onto the target fabric to provide a sufficient degree of rigidity.

To be effective (i.e., to impart the proper degree of rigidity or immobilization to the target fibers), the coating does not have to fill the entire free space of the yarn; however, a solids coating level of between 5 and 50% by the weight of the fabric has been found to be particularly effective. A coating range of between 10 and 25% of the weight of the fabric is most preferred. In one particularly preferred embodiment, a greige fabric is to be subsequently treated through sanding, abrading, or napping but does not require any further application of size. As long as the size present during the weaving procedure is not removed thereafter, sufficient rigidity will exist for proper immobilization of the target fabric for further treatment by sanding, abrading, or napping within the inventive process. Another preferred method of immobilization through size application is to dissolve the coating agent in water and pad onto the fabric, followed by a drying step; however, this encompasses both sized (greige) and de-sized fabrics.

Another temporary coating available within the inventive immobilization step is ice. In such an instance, 50 to 200% by weight of water is applied to the target fabric that is subsequently exposed to subfreezing temperatures until frozen. The fabric is then abraded while frozen and then dried. One embodiment of this type of immobilization includes padding on at least about 50% owf and at most about 200% owf water and then freezing the water in situ. Such a method may be utilized on greige, prepared, or finished goods and it eliminates the need to add extra amounts of size to an already-woven fabric. This elimination of the need to add and recover size is therefore highly cost-effective. If ice is utilized to immobilize the constituent fibers of the target fabric, napping with metal wires or brushes is the preferable method of treating the target fabric. Wire allows ice, which has melted and refrozen, to break free easily. The resultant ice film could render sanders and/or abraders ineffective since the grit generally utilized in those procedures is very small and would not penetrate through the film to "nick" the individual fibers as is necessary for this inventive process to function properly. The frozen target fabric is preferably maintained at a low temperature (at least from about −10 to about −50° C.), both to insure that the ice has sufficient shear strength for immobilization, and to provide enough heat capacity to absorb the mechanical energy imparted by the abrasion process without melting.

As noted above, the size employed as an aid to weaving may be retained subsequent to weaving, and employed in the present invention to immobilize the target fibers. This is believed to be unique within the textile industry. While such processes as singeing and heat-setting may be applied to greige goods, neither process obtains the advantages from the presence of size on the greige fabric. Otherwise, size is removed from greige goods prior to any further treatment (such as mercerizing, bleaching, dyeing, napping, sanding, and the like).

The most important step to the inventive method is the immobilization of the surface fibers. Abrading, sanding, sueding, napping, and the like, (or combinations of these) may be utilized as the fabric treatment step within the inventive process. Thus, abrading through contacting a fabric surface with an abrasive-coated cylindrical drum rotating a speed different from that of the fabric web is one preferred embodiment within this inventive process. Such a method is more fully described in U.S. Pat. Nos. 5,752,300 and 5,815,896, both to Dischler, herein entirely incorporated by reference. Angular sueding, as in U.S. patent application Ser. No. 09/045,094 to Dischler, also herein entirely incorporated by reference, is also an available method. The preferred abrasive is diamond grit embedded in an electroplated metal matrix that preferably comprises nickel or chromium, such as taught within U.S. Pat. No. 4,608,128 to Farmer. Other hard abrasive particles may also be used such as carbides, borides, and nitrides of metals and/or silicon, and hard compounds comprising carbon and nitrogen. Electroless plating methods may also be utilized to embed diamond and other hard abrasive grit particles within a suitable matrix. Preferably, the diamond grit particles are embedded within the plated metal surface of a treatment roll with which the target fabric may be brought into contact so that there is motion of the fabric relative to the grit particles. Since both the diamond facets and the metal matrix are microscopically smooth, build-up of size coating on the abrasive treatment surface is generally easily avoided. However, as noted previously, a more severe problem occurs where ice is utilized as the immobilizing matrix. The pressure of the fabric in contact with the small abrasive grit particles may cause the ice to melt and instantly refreeze onto the abrasive-coated cylinder. Also, since ice is generally weaker than polymeric sizing agents, a greater weight add-on is required to provide sufficient rigidity to the individual fibers. A thicker layer of coating thus results oh the surface, and this superficial ice thickness interferes with the contact of the grit particles with the target fibers. As such, the grit particles would not be sufficient to "nick" the surface fibers. In such an instance, a napping procedure is preferred which utilizes wire brushes to condition the fabric surface, as taught in U.S. Pat. No. 4,463,483 to Holm. A cylindrical drum may still be utilized in such a situation with a napping wire wrapped around the drum which is then brought into contact with the target fabric, again a speed different from that of the fabric web. Normally, napping in this manner pulls the surface fibers away from the fabric surface; in the inventive method, the fibers are held in place and the desirable and necessary "nicking" of the individual fibers is thus accomplished. The bending of the wire during contact with the fabric allows ice to continually break free while the length of the wire insures that the ice coating can be penetrated and the "nicking" procedure is, again, accomplished.

As noted previously, the term "non-directionality" concerns the appearance of the pile fibers on the target fabric surface after range-dyeing. Substantially all such fibers will exhibit the same appearance due to substantially the same degree of sueding in opposing directions, thereby producing a shorter and more uniform pile than with other standard sanding, etc., techniques. Such a shorter pile thus provides resistance to bending of the individual fibers when contacted by a sueding surface (rollers, and the like). Such a substantial uniformity in treatment thus imparts an appearance which is generally the same from viewpoints in every direction. "Directionality" would thus pertain to a fabric that exhibited at least two different appearances to a viewer when analyzing a specific area of the fabric in at least two different directions.

Such appearances, pertaining solely to the uniform colored appearance of the constituent fibers of the target fabric, can actually be measured through the comparative analysis of portions of the target fabric surface. Fabric color generally varies by viewing angle. The color variation is usually relatively small and thus such an effect is usually not visually apparent to an observer who examines one fabric sample in the absence of any other color references. Sufficiently large differences are easily apparent when seaming fabric together at different orientations. Differences in appearances may occur (even for simple plain weave fabric) which visually are undesirable for seamed garments comprising separately dyed and treated fabrics. As noted above, hand is of utmost importance in providing a comfortable, pleasing fabric for an apparel fabric. Thus, the fabric itself must be mechanically finished after production to relax the constituent fibers (but without losing too much strength to keep the fabric intact). Face finishing, such as sueding, sanding, and the like, theoretically,.at least, provides a balanced, even treatment to the target fabric; however, since most finishing is accomplished in one direction (the fabric web travels in one direction and is treated, primarily, by a sueding procedure parallel to the web direction), the appearance of the finished fabric in one direction will not be the same as at a viewing direction transverse to the first. Thus, upon production and separation of the finished fabric (to form the component fabric parts for the ultimately desired article), noticeable variations in appearances exist (i.e., directionality problems) which, after range-dyeing, result in color variations for the fabrics themselves. Since, as noted above, range-dyeing, being a continuous method (as opposed to jet-dyeing), is a preferred procedure for efficiency reasons, the target fabric should be produced in such a way as to substantially eliminate these directionality problems.

For the purposes of this invention, the term and thus label of non-directional as it pertains to particular fabrics is intended to be determined through a relatively simple and objective spectrophotometric procedure. The analyzed fabric is laid flat with a light source placed at a certain distance from the sample fabric at an angle of about 45°. In such a configuration, a "gloss angle" measured to be 90° from the light source is theoretically produced. Light detectors are then placed at both 20° and 45° (measured angularly in the direction towards the light source), either simultaneously or at different times, in relation to the "gloss angle" and at a distance from the fabric essentially the same as the light source. These measurement angles simulate the visual perception of a person viewing the sample fabric surface and may, in fact, actually be at any angle. For this invention, however, the directionality (or nondirectionality) characteristics must meet specific measurements at both of these measurement angles. A spectrophotometer is then placed over a selected portion of the laid-flat fabric with a spectro port to permit light through to the fabric surface. The area of analyzed fabric through the spectro port is roughly 1.5 cm in diameter but provides an excellent and sufficient manner of predicting the directionality characteristics of the overall fabric (if the fabric itself has a substantially uniform empirical appearance). The light source is switched on and a reading for reflectance is measured by the set light detector (to determine a standard measurement at that specific angle) through the spectrophotometer. The fabric sample is then rotated 180° with the light source and light detector remaining in the exact same position. The light source is again switched on and a new reading is taken by the light detector as it relates to the specific fabric in the totally opposite direction from the initial standard measurement. The directionality difference between the initial fabric direction and the 180° rotated measurement is calculated for each sample using the following equation:

$$\Delta E^*=((L^*_{0°}-L^*_{180°})^2+(a^*_{0°}-a^*_{180°})^2+(b^*_{0°}-b^*_{180°})^2)^{1/2}$$

wherein ΔE* represents the difference in color between the fabric in the initial direction and the fabric rotated 180° to the initial initial direction. In the above equation, L*, a*, and b* are the color coordinates; wherein L* is a measure of the lightness and darkness of the fabric sample; a* is a measure of the redness or greenness of the fabric sample; and b* is a measure of the yellowness or blueness of the fabric sample. For a further discussion and explanation of this testing procedure, see Billmeyer, F. W., et al., *Principles of Color Technology*, 2nd Edition, pp. 62–64 and 101–04. If the ΔE* measurement for a specific light detector disposed at a single angle for all necessary measurements is at most 1.75, preferably, about 1.5, more preferably about 1.4, most preferably below about 1.0, the fabric is considered to exhibit suitable non-directional characteristics such that the naked eye will not be able to discern sufficient color variations on the fabric surface. This test may then be repeated for other fabric samples for comparison with other samples to be utilized within the same target apparel article; however, as long as each individual fabric meets its own nondirectionality characterization, it is accepted that those fabrics will most likely be suitable as adjacent utilized components within the target apparel article. Furthermore, if the target fabric is patterned in relation to directional and nondirectional discrete areas, this test may be utilized on only the directional or nondirectional portion of the analyzed fabric to determine the potential nondirectional characteristics of the sample (i.e, the sample may have been treated wherein selective immobilization of fibers in discrete areas of the target fabric was practiced, as one possible example). Also, the light source may be of different types, including, and preferably, incandescent light (100 watt bulb, for instance), fluorescent light (cool white, for instance), and sunlight simulations (D65 sunlight measurements, for instance).

The requisite range-dyeing of the inventive fabric may be performed in any standard range-dyeing method. This method generally requires the continuous dyeing of a fabric web through a dye bath and subsequent ovens, other fixing baths, and the like. Thermosol processes are most preferred in this type of dyeing; although, any method which permits continuous web dyeing is possible in this invention. The fabric dyes themselves may be of any standard type, including, without limitation, vat dyes, disperse dyes, reactive dyes, solvent dyes, and the like. Certain dyes are more preferable with certain constituent fibers; for instance, disperse dyes color polyester, vat dyes and reactive dyes color cotton, and so on. Thus, the selection of dyes will depend upon the fibers present within the target fabric itself. The amounts of such dyes within the dye bath or baths may be in any proportions necessary to impart a desired color level to the target fabric. Thus, any range from 0.00001 lb/gal to about 2.0 lb/gal may be utilized. Such amounts would be apreciated by the ordinarily skilled artisan. Also, one of ordinary skill in this art would appreciate that certain additives, such as fixing agents, reducing agents, oxidizers, antimigration compounds, such as acrylate polymers, and the like (to fix the dyes and prevent migration of the dyes from the fabric), solvents, ultraviolet absorbers, penetrants, such as alcohols (to allow for rewetting of the fabric surface to permit more thorough introduction of the dyes into the fabric), surfactants, and the like, may be present in the dye bath or baths as well.

The particular types of fabrics which may be subjected to the inventive method are myriad. Such include, without limitation, any synthetic and/or natural fibers, including synthetic fibers selected from the group consisting of polyester, polyamide, polyaramid, rayon, spandex, and blends thereof, and natural fibers are selected from the group consisting of cotton, wool, flax, silk, ramie, and any blends thereof. The fabrics may also be constructed as woven, non-woven, and/or knit materials. Preferably, the target fabric comprises synthetic fibers and is woven. More preferably, the fabric comprises woven polyester fibers in spun yarns.

It has been determined that warp-faced twill fabrics are particularly suited to this inventive process because all of the exposed surface yarns of the woven substrate are sized which thus results in immobilization of all of the desired fibers thereby facilitating the "nicking" procedure described above. Furthermore, the costs associated with padding on size, drying, and de-sizing may also be avoided in some cases by abrading the fabric in the greige state. Usually, the warp yarns are sized prior to weaving in order to protect them from damage while fill yarns are generally untreated. If the fabric is warp-faced (e.g., a warp-faced twill fabric), then the abrasion step may be directly performed on the face, without any added processing steps required. Surprisingly, this approach has been found to be successful with plain woven fabrics, even though the fill yarns are not sized. In these fabrics, directly from the loom, the fill is comparatively straight and therefore is buried in the fabric structure (and thus much less accessible to the abrasive treatment). Generally, fabric that has been so treated is then processed in the normal manner, which. typically combines steps such as de-sizing, mercerizing, bleaching, dyeing, and finishing. In special cases, the fabric may be sold to converters directly after the abrasion process. The converter would then do all or part of the subsequent processing. In cases where the size has functionality, it can be left on the fabric and can become part of the final product. For instance, in the case of abrasive-coated cloth (i.e., where it is desired to bond abrasive grit particles to the cloth) the size acts as a primer coat keeping the resin at the surface and physically preventing it from penetrating the body of the cloth in an uncontrolled fashion.

Also of particular interest within this invention is the fact that sueding of cotton/synthetic fiber blend fabrics (such as 65% cotton/35% polyester poplin) in the greige state, prior to mercerization, is now known to produce unexpectedly beneficial effects. Historically, synthetic fibers for use in apparel, including polyester fibers, have generally been supplied to the textile industry with the object of duplicating or improving upon the characteristics of natural fibers. Such synthetic textile filaments were mostly of a denier per filament (dpf) in a range similar to those of the standard natural fibers (i.e., cotton and wool). More recently, however, polyester filaments have been available on a commercial level in a range of dpfs similar to natural silk (i.e., of the order of 1 dpf), and even in subdeniers (below 1 dpf). Such fibers and considerably finer and more flexible than typical cotton fibers and thus are potentially preferred in the industry over such natural fibers. It has thus been discovered that fabrics containing cotton blended with such low dpf polyester fibers treated in accordance with this inventive method, then subsequently mercerized, exhibit a sueded surface that is substantially dominated by the synthetic fibers. This effect occurs because the cotton portion of the generated pile tends to kink, bend, and shorten due to the swelling effect of the caustic on the cut cotton fibers. These fibers tend to swell to the greatest possible degree since they are not tensioned. Kinking and bending is further accentuated by the presence of "nicks" on these fibers, resulting in localized swelling where the cuticle of the cotton fiber is breached. The same effect does not occur with the cut polyester or other synthetic fibers that do not swell in the presence of caustic, so that the synthetic fibers ultimately dominate the surface aesthetics. This is advantageous when the target fabric contains synthetic fibers that are more flexible than mercerized cotton fibers, usually in the range of 1.5 dpf or less for polyester fibers. Such a benefit has not been readily available to the industry until now.

Any standard sueding and sanding (and possibly, though much less desired, napping) machine may be utilized to produce the inventive fabrics. As merely a few examples, potentially and preferably utilized machines include those disclosed within U.S. Pat. Nos. 5,943,745 and 5,815,896, both to Dischler. However, the particularly preferred machine for the production of the finished inventive fabrics comprises at least one treatment tube to which diamond grit has been incorporated within an electroplated nickel matrix. The tube is set to rotate either with or against the direction of the web of fabric to be treated and is configured either substantially perpendicular to or angularly related to said fabric web. The rotation speed of the tube (or even more preferably tubes) is greater than that of the speed of the fabric web. With the fibers of the fabric being immobilized (through the non-removal of size after weaving, for instance), this particular machine thus permits the desired "nicking" of the constituent fibers and the minimal pulling of such fibers from the fabric face. In such a procedure, the resultant pile height is very low, yet the fabric itself exhibits hand characteristics comparable to non-immobilized fiber treatments for similar types of fabrics. It is preferred that the abrasive covered tubes be utilized in counterrotating pairs so that an equal amount of treatment is imparted in each direction on the target fabric surface. Furthermore, when both sides of the target fabric are to be treated, it is preferred that the face be treated first with a subsequent treatment to the back side. This specific sequential treatment best ensures that, if any breakdown of the immobilizing coating matrix (such as, preferably, size) occurs, any cut long hairs present on the back side of the fabric will not thereafter be pulled from the target fabric face. The actual machine is described in greater detail in the drawings discussed below.

DETAILED DESCRIPTION OF THE DRAWINGS

Figure 1:
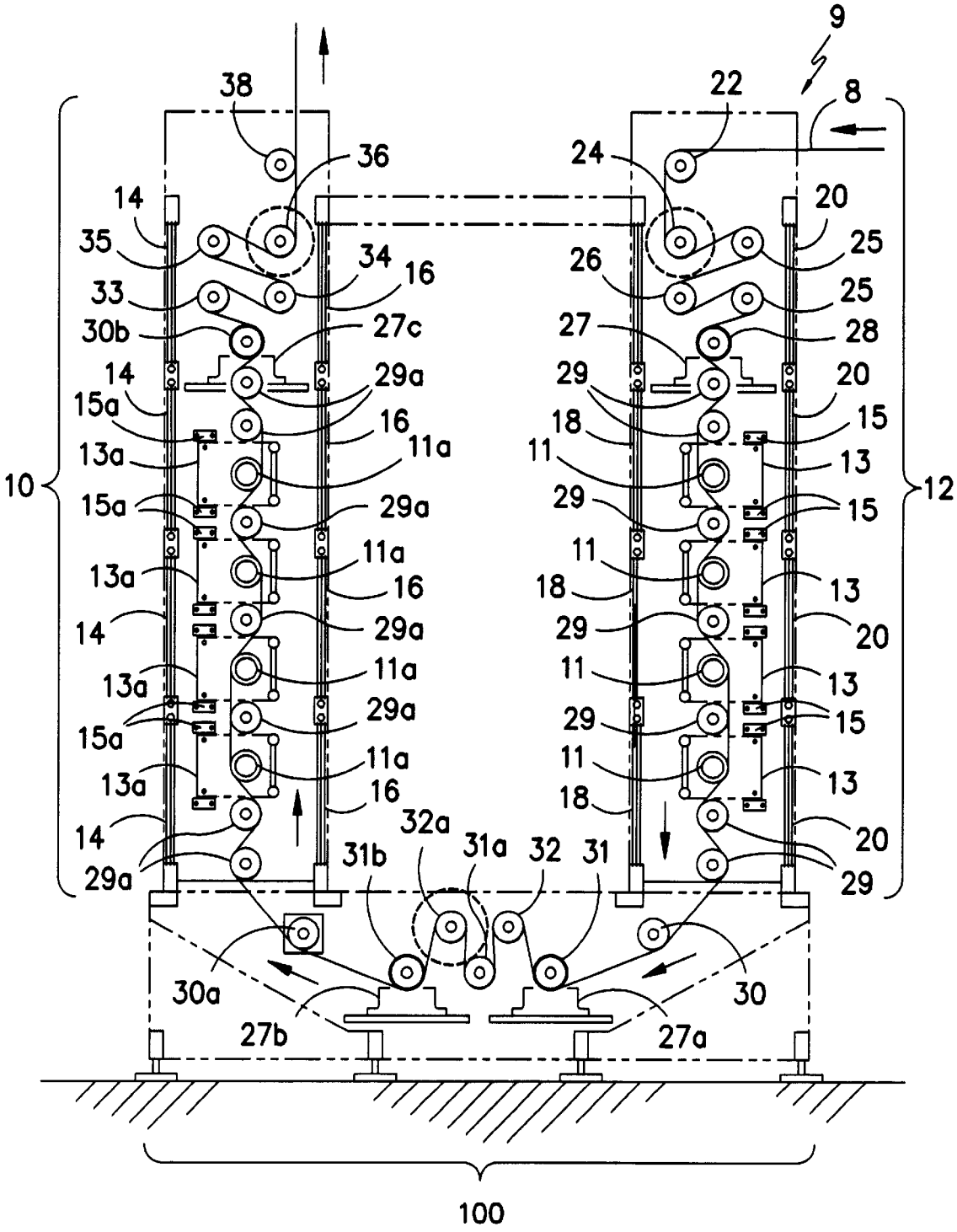
FIG. 1 represents a cross-sectional view of the preferred fabric treatment apparatus.

As depicted in FIG. 1, a web of fabric 8 is moved through an apparatus 9 having two separate treatment chambers 10, 12, and an intermediate chamber 100. After the web 8 enters the first treatment chamber 12, it is directed over idler roll 22 to drive rolls 24, 26, which are geared together in a one-to-one relationship by means of a synchronous belt (not shown). Sufficient wrap on the drive rolls to achieve traction on the web is accomplished by directing the web over idler rolls 25, 27. The fabric is then directed over idler roll 28, equipped with load cell blocks 27 mounted on each end of idler roll 28. The output from load cell blocks 27 (serving the same purpose as a dancer roll) is used to regulate the relative speed of drive rolls 24, 26 with the next pair of drive rolls 32, 32*a*, and thereby control the tension of the web 8.

The web is then directed into contact with treatment rolls or tubes 11, 11*a*, which are interspersed with idler rolls 29, 29*a*. In a most preferred embodiment, the treatment rolls or tubes 11, 11*a* are configured in pairs, with a first roll or tube rotating in an opposite but even direction from the second roll or tube 11, 11*a*. Such a configuration gives the most balanced and thorough treatment of the fabric web 8. The drawings show a particular orientation of the web 8 to the treatment rolls 11 wherein first one side and then the other side of the web is contacted by the treatment rolls 11. However, the idler rolls 29 and treatment rolls 11 are symmetrically oriented in a line, so that the web path may be altered by threading up the web to either side of the treatment rolls 11, so that either the face or back of the web is treated by a particular treatment roll 11, as desired for a particular fabric style.

After treatment in chamber 12, the web 8 passes into intermediate chamber 100, passing under scroll roll 30 to idler roll 31, which is mounted each end on load cell blocks 27*a*, whereby tension of the web 8 is measured and compared to the tension measured with load cells 27, as a quality check. The web is then directed to drive roll 32, to idler roll 31*a* and to drive roll 32*a*, geared in a one to one relationship with drive roll 32. Subsequently, the web 8 passes under idler roll 31*b*, equipped at each end with load cell blocks 27*b*, which serve to control to tension of the web 8 in treatment chamber 10. The output from load cell blocks 27*b* is used to regulate the relative speed of drive rolls 32, 32*a* with the next pair of drive rolls 34, 36, and thereby control the tension of the web 8 within the chamber 10.

The web passes under scroll roll 30*a*, which serves to further open the web before entering the treatment chamber 10. This opening is particularly desirable if the tension used in the treatment chamber 10 is less than that used in treatment chamber 12.

The fabric web 8 then enters treatment chamber 10, wherein spaced idler rolls 29*a* serve to contact the web against treatment rolls 11*a*. Again, the drawings show a particular orientation of the web to the treatment rolls 11 wherein first one side and then the other side of the web is contacted by the treatment rolls 11*a*. However, the idler rolls 29 and treatment rolls 11 are symmetrically oriented in a line, so that the web path may be altered so that either that the face or back of the web is treated by a particular treatment roll 11*a*, as desired for a particular fabric style.

After treatment in chamber 10, the fabric is directed around idler roll 30*b*, equipped at each end with load cell blocks 27*c*, whereby tension of the web 8 is measured and compared to the tension measured with load cells 27*b*, as a quality check. Subsequently, the web 8 is directed over idler roll 33 to drive rolls 34, 36, which are geared together in a one-to-one relationship by means of a synchronous belt (not shown). Sufficient wrap on the drive rolls to achieve traction on the web is accomplished by directing the web over idler rolls 35, 38. The web is then directed away from the apparatus 9.

The entire apparatus 9 is sealed to prevent leakage of lint into the environment. Slideable windows 14, 16, 18, 20 allow the treatment areas to be accessed and viewed. Lint created by contact of the web 8 with the treatment rolls 11 falls into the intermediate chamber 100 and is removed by ductwork attached thereto (not shown).

Although the preferred apparatus comprises eight treatment rolls or tubes, it is to be understood and would be well appreciated by one of ordinary skill in the art that any number of rolls or tubes may be utilized. In fact, the same apparatus but with four treatment rolls, either in one chamber or separated into two mirror-image chambers are preferred as well. The examples listed below actually utilized a four-roll configuration in a single chamber.

DETAILED DESCRIPTION AND PREFERRED EMBODIMENTS OF THE INVENTION

The above as well as other objects of the invention will become more apparent from the following detailed examples representing the preferred embodiments of the invention.

EXAMPLE 1

A sample 7.5 ounce per linear yard (66 inches wide) plain weave fabric comprised of an intimate blend of 65% polyester and 35% cotton and completely constructed of open-end spun yarns was treated. The fabric was woven with sized (polyvinyl alcohol) yarns into a structure of 102 ends to 52 picks per square inch. After weaving, the fabric was not scoured to remove the size and then was subjected to treatment with the four-roll machine noted above. After treatment, the sample was first scoured to remove the immobilizing size, then mercerized (to open up the cotton fibers), and subsequently dyed through a range-dyed, continuous, thermosol process. This range-dyed process was performed by running (continuous immersion procedure) the web through a dyebath comprising both polyester dyes (specifically 0.01466 lb/gal of Disperse Yellow 114, 0.05570 lb/gal Disperse Red 167, and 0.22867 Disperse Blue 79) and cotton dyes (0.22163 Vat Violet 13, 0.17034 lb/gal Vat Violet 1, and 0.17446 Vat Blue 6), with 0.1 lb/gal of an antimigrant (an acrylate copolymer compound available from Glotex International Incorporated, under the tradename Astro-Therm® 111B) and 0.04 20% aqueous acetic acid, all in an aqueous solution. (The resultant fabric was colored navy blue.) The web then proceeded through a dry, heated oven to fix the polyester dyes at a temperature of about 425° F. The web then proceeded to a padding station to apply sodium sulfate to the surface as a reducing agent for the cotton dyes. Subsequently, the web entered a steam heated oven (temperature of about 200° F) to effectuate the necessary dye reduction and permit reaction of the cotton dyes with the cotton surface fibers. The fabric was then padded with a dilute peroxide solution in order to oxidize the dyes to provide the desired colors on the surface. After drying, the fabric was then washed again and then tested for directionality variations on the surface. The testing was accomplished through the placement of a GretagMacbeth Model #CE741GL Spectrophotometer on the sample fabric with a spectro port centered over any selected portion of the fabric. The light source (of which three different ones were used to produce three different measurements) was placed at an angle of 45° and a distance of about 0 meters, from the spectro port. Two different light detectors (internal to the spectrophotometer and specific to the model) were then placed at angles of 20° and 45°, respectively, in relation to and directly adjacent to the spectro port. The light source was lit and the initial L*, a* and b* measurements were taken for the fabric. The light source was then extinguished, and the sample fabric was rotated 180° from the initial measurement. The light source was again lit, and the same measurements were taken by the detectors. The resultant directionality measurements are tabulated below:

TABLE 1

| Light Source | Angle | ΔL* | Δa* | Δb* | ΔE* |
|---|---|---|---|---|---|
| Incandescent | 20 | −0.769 | −0.144 | −0.771 | 1.098 |
| Cool White Fluorescent | 20 | −.0761 | 0.115 | −0.805 | 1.114 |
| D65 | 20 | −0.696 | 0.098 | −0.675 | 0.974 |
| Incandescent | 45 | −0.789 | −0.183 | 0.190 | 0.832 |
| Cool White Fluorescent | 45 | −0.778 | −0.188 | 0.298 | 0.854 |
| D65 | 45 | −0.776 | −0.238 | 0.233 | 0.844 |

In each instance, the fabric was measured in a first warp direction and then 180° from the first warp direction. From the perspective of directionality then, the sample fabric exhibited no visual color variations on the surface at the selected location from one direction to its exact opposite. For a range-dyed, finished fabric, such a lack of directional characteristics is highly unique, desirable, and unexpected.

EXAMPLE 2

The same base fabric as in EXAMPLE 1 was treated in the same manner except that a red color was imparted to the fabric through utilization of polyester dyes (specifically 0.04827 lb/gal of Disperse Red 5 and 0.16743 lb/gal Disperse Red 356) and cotton dyes (0.02661 lb/gal Reactive Orange 116, 0.47170 lb/gal Reactive Red 238, and 0.00671 lb/gal Reactive Blue 235), with 0.1 lb/gal of an antimigrant (Astrotherm® 111B), 0.01868 lb/gal 20% aqueous acetic acid, and 0.01250 lb/gal of a penetrant (an anionic ethoxylated alcohol available from Clariant under the tradename Penetrant EH) all in an aqueous solution. The sample was washed and tested in the same manner as in EXAMPLE 1 as well. The resultant fabric exhibited the following tabulated directionality characteristics:

TABLE 2

| Light Source | Angle | ΔL* | Δa* | Δb* | ΔE* |
|---|---|---|---|---|---|
| Incandescent | 20 | 0.852 | −0.600 | −0.668 | 1.238 |
| Cool White Fluorescent | 20 | 1.067 | −0.581 | −0.184 | 1.229 |
| D65 | 20 | 0.996 | −0.772 | −0.374 | 1.314 |
| Incandescent | 45 | 1.159 | 0.021 | −0.674 | 1.341 |
| Cool White Fluorescent | 45 | 1.274 | 0.043 | −0.469 | 1.358 |
| D65 | 45 | 1.213 | −0.017 | −0.578 | 1.344 |

From the perspective of directionality then, the sample fabric exhibited no visual color variations on the surface at the selected location from the first direction to its exact opposite. For a range-dyed, finished fabric, such a lack of directional characteristics is highly unique, desirable, and unexpected.

EXAMPLE 3

The same base fabric as in EXAMPLE 1 was treated in the same manner except that a light blue-green color (seafoam) was imparted to the fabric through utilization of a polyester dyes (specifically 0.00532 lb/gal of Disperse Yellow 114, 0.00138 lb/gal Disperse Red 356, and 0.00392 Disperse Blue 165) and cotton dyes (0.00825 Vat Yellow 33, 0.00037 lb/gal Vat Red 10, and 0.01762 Vat Blue 66), with 0.1 lb/gal of an antimigrant (Astrotherm® 111B) and 0.00933 20% aqueous acetic acid, all in an aqueous solution. The sample was washed and tested in the same manner as in EXAMPLE 1 as well. The resultant fabric exhibited the following tabulated directionality characteristics:

TABLE 3

| Light Source | Angle | ΔL* | Δa* | Δb* | ΔE* |
|---|---|---|---|---|---|
| Incandescent | 20 | 0.769 | 0.147 | 0.041 | 0.784 |
| Cool White Fluorescent | 20 | 0.769 | 0.141 | −0.005 | 0.782 |
| D65 | 20 | 0.749 | 0.207 | −0.024 | 0.777 |
| Incandescent | 45 | 0.547 | 0.215 | 0.068 | 0.592 |
| Cool White Fluorescent | 45 | 0.551 | 0.213 | 0.026 | 0.591 |
| D65 | 45 | 0.517 | 0.298 | −0.019 | 0.597 |

From the perspective of directionality then, the sample fabric exhibited no visual color variations on the surface at the selected location from one perception angle to its exact opposite. For a range-dyed, finished fabric, such a lack of directional characteristics is highly unique, desirable, and unexpected.

EXAMPLES 4–8 (COMPARATIVES)

Five sample fabrics of plain weave construction and 102 ends by 48 picks per square inch were dyed with the same navy dyes as in EXAMPLE 1 above. These were finished and dyed in accordance with the following TABLE 4. Any finishing treatments were performed in accordance with standard sanding techniques and without the immobilization of any fibers on the surface. The colors listed below were provided with the same exact dyes and colorants as in EXAMPLEs 1–3, above (navy blue is the same as EXAMPLE 1, red as EXAMPLE 2, seafoam as EXAMPLE 3). The fabrics thus exhibited the following characteristics:

TABLE 4

| Example # | Finishing Treatment | Dye Method |
|---|---|---|
| 4 | none | Range (navy blue) |
| 5 | Sanding (Diamond Grit) on back side only | Range (navy blue) |
| 6 | Sanding (Diamond Grit) on front and back | Range (navy blue) |
| 7 | Sanding (Wesero sandpaper) | Range (seafoam) |
| 8 | Sanding (Gessner sandpaper) | Jet (navy blue) |

The individual samples were then analyzed for directional characteristics as in EXAMPLEs 1–3, above. The results are tabulated as follows:

TABLE 5

| Ex. # | Light Source | Angle | ΔL* | Δa* | Δb* | ΔE* |
|---|---|---|---|---|---|---|
| 4 | Incandescent | 20 | 1.618 | 0.113 | 0.910 | 1.860 |
| 4 | Cool White Fluorescent | 20 | 1.621 | −0.144 | 0.986 | 1.903 |
| 4 | D65 | 20 | 1.532 | −0.143 | 0.787 | 1.728 |
| 4 | Incandescent | 45 | 1.000 | 0.262 | 0.494 | 1.146 |
| 4 | Cool White Fluorescent | 45 | 0.985 | 0.054 | 0.531 | 1.120 |
| 4 | D65 | 45 | 0.936 | 0.063 | 0.404 | 1.021 |
| 5 | Incandescent | 20 | 1.421 | 0.100 | 0.611 | 1.550 |
| 5 | Cool White Fluorescent | 20 | 1.412 | −0.089 | 0.612 | 1.541 |
| 5 | D65 | 20 | 1.363 | −0.131 | 0.535 | 1.470 |
| 5 | Incandescent | 45 | 1.105 | 0.122 | 0.062 | 1.113 |
| 5 | Cool White Fluorescent | 45 | 1.083 | 0.014 | 0.037 | 1.084 |

TABLE 5-continued

| Ex. # | Light Source | Angle | ΔL* | Δa* | Δb* | ΔE* |
|---|---|---|---|---|---|---|
| 5 | D65 | 45 | 1.090 | −0.012 | 0.046 | 1.091 |
| 6 | Incandescent | 20 | 2.258 | 0.020 | 0.486 | 2.310 |
| 6 | Cool White Fluorescent | 20 | 2.510 | −0.202 | 0.522 | 2.572 |
| 6 | D65 | 20 | 2.213 | −0.230 | 0.436 | 2.267 |
| 6 | Incandescent | 45 | 2.344 | −0.178 | 0.179 | 2.358 |
| 6 | Cool White Fluorescent | 45 | 2.342 | −0.263 | 0.196 | 2.365 |
| 6 | D65 | 45 | 2.343 | −0.385 | 0.211 | 2.384 |
| 7 | Incandescent | 20 | 1.521 | 0.081 | 0.432 | 1.583 |
| 7 | Cool White Fluorescent | 20 | 1.528 | −0.026 | 0.429 | 1.587 |
| 7 | D65 | 20 | 1.467 | −0.012 | 0.334 | 1.505 |
| 7 | Incandescent | 45 | 2.313 | 0.067 | −0.245 | 2.327 |
| 7 | Cool White Fluorescent | 45 | 2.291 | 0.060 | −0.301 | 2.311 |
| 7 | D65 | 45 | 2.312 | 0.035 | −0.263 | 2.327 |
| 8 | Incandescent | 20 | −0.517 | 0.001 | −0.096 | 0.526 |
| 8 | Cool White Fluorescent | 20 | −0.516 | 0.082 | −0.118 | 0.536 |
| 8 | D65 | 20 | −0.508 | 0.060 | −0.083 | 0.518 |
| 8 | Incandescent | 45 | 0.388 | 0.117 | −0.212 | 0.457 |
| 8 | Cool White Fluorescent | 45 | 0.374 | 0.148 | −0.227 | 0.462 |
| 8 | D65 | 45 | 0.394 | 0.116 | −0.200 | 0.457 |

Clearly, and predictably, the jet-dyed fabric (EXAMPLE 8) provided the best directionality characteristics. The non-finished range-dyed fabric (EXAMPLE 4) was insufficient from both a hand and directionality perspective. The only-back-side finished fabric (EXAMPLE 5) predictably showed effective directionality measurements; however, the front side (face) did not exhibit the desirable hand (since it was not finished). EXAMPLE 6 clearly did not provide desirable directionality characteristics, although the hand for this fabric was predictably suitable. Lastly, the sanded, range-dyed fabric (EXAMPLE 7) was suitable for directionality only at a 20° detection angle; the 45° measurement was clearly deficient and exhibited visible color variations.

EXAMPLES 9–10 (COMPARATIVES)

Three more sample fabrics of plain weave construction and 102 ends by 52 picks per square inch were dyed with the same red dyes as in EXAMPLE 2 above and seafoam color dyes as in EXAMPLE 3, above. One other fabric was dyed a blue color through the same general range dyeing techniques as for EXAMPLE 1, above. These fabrics were finished and dyed in accordance with the following TABLE 5. Any finishing treatments were performed in accordance with standard sanding techniques and without the immobilization of any fibers on the surface. The fabrics thus exhibited the following characteristics:

TABLE 6

| Example # | Finishing Treatment | Dye Method |
|---|---|---|
| 9 | none | Range (Red) |
| 10 | none | Range (Seafoam) |

The individual samples were then analyzed for directional characteristics as in EXAMPLEs 1–3, above. The results are tabulated as follows:

TABLE 7

| Ex. # | Light Source | Angle | ΔL* | Δa* | Δb* | ΔE* |
|---|---|---|---|---|---|---|
| 9 | Incandescent | 20 | −1.329 | −0.238 | 0.336 | 1.391 |
| 9 | Cool White Fluorescent | 20 | −1.379 | −0.142 | 0.266 | 1.412 |
| 9 | D65 | 20 | −1.339 | −0.180 | 0.330 | 1.391 |
| 9 | Incandescent | 45 | −0.978 | −0.190 | 0.290 | 1.038 |
| 9 | Cool White Fluorescent | 45 | −1.022 | −0.141 | 0.202 | 1.051 |
| 9 | D65 | 45 | −0.987 | −0.154 | 0.279 | 1.037 |
| 10 | Incandescent | 20 | −0.367 | −0.152 | 0.280 | 0.486 |
| 10 | Cool White Fluorescent | 20 | −0.373 | −0.214 | 0.369 | 0.567 |
| 10 | D65 | 20 | −0.360 | −0.286 | 0.335 | 0.569 |
| 10 | Incandescent | 45 | −0.597 | −0.249 | 0.222 | 0.684 |
| 10 | Cool White Fluorescent | 45 | −0.603 | −0.309 | 0.337 | 0.757 |
| 10 | D65 | 45 | −0.575 | −0.411 | 0.316 | 0.774 |

The non-finished range-dyed fabrics were sufficient from both a directionality perspective; however, the hand characteristics were, predictably, unsatisfactory.

It is not intended that the scope of the invention be limited to the specific embodiments described herein, rather, it is intended that the scope of the invention be defined by the appended claims and their equivalents.

What is claimed is:

1. A range-dyed fabric having a first face and a second face and comprised of individual fibers therein at both of said first face and said second face, wherein at least one of said first face and said second face has been mechanically finished by nicking at least a plurality of individual fibers at either of said first face or said second face to impart a soft hand thereto, wherein said individual fibers are not pulled during said mechanical finishing such that a napped surface is not produced thereby, and wherein said mechanically finished face exhibits a directionality measurement in appearance and under a light source selected from the group consisting of incandescent light, fluorescent light, and simulated sunlight, of at most 1.75 as measured at both 20° and 45° detection angles in relation to a gloss angle.

2. The fabric of claim 1 wherein said fabric is comprised of yarns selected from the group consisting of natural fibers, synthetic fibers, and any blends thereof.

3. The fabric of claim 2 wherein said fabric is comprised of a blend of natural and synthetic fibers.

4. The fabric of claim 3 wherein said fabric is comprised of a blend of cotton and polyester fibers.

5. The fabric of claim 1 wherein said fabric is range-dyed in a thermosol process.

6. The fabric of claim 2 wherein said fabric is range-dyed in a thermosol process.

7. The fabric of claim 3 wherein said fabric is range-dyed in a thermosol process.

8. The fabric of claim 4 wherein said fabric is range-dyed in a thermosol process.

9. The fabric of claim 1 wherein said directionality measurement for said mechanically finished face is at most 1.5 for both measurement angles.

10. The fabric of claim 9 wherein said directionality measurement for said mechanically finished face is at most 1.4 for both measurement angles.

11. The fabric of claim 9 wherein said fabric is comprised of yarns selected from the group consisting of natural fibers, synthetic fibers, and any blends thereof.

12. The fabric of claim 11 wherein said fabric is comprised of a blend of natural and synthetic fibers.

13. The fabric of claim 12 wherein said fabric is comprised of a blend of cotton and polyester fibers.

14. The fabric of claim 13 wherein said fabric is range-dyed in a thermosol process.

15. The fabric of claim 10 wherein said fabric is comprised of yarns selected from the group consisting of natural fibers, synthetic fibers, and any blends thereof.

16. The fabric of claim 15 wherein said fabric is comprised of a blend of natural and synthetic fibers.

17. The fabric of claim 16 wherein said fabric is comprised of a blend of cotton and polyester fibers.

18. The fabric of claim 17 wherein said fabric is range-dyed in a thermosol process.

19. A comprising a plurality of nicked individual fibers and exhibits a hand that is softer than that exhibited by the same fabric without any nicked individual fibers, at least a portion of which is range-dyed and mechanically finished, wherein said range-dyed and mechanically finished fabric portion is non-directional, wherein said individual fibers are not pulled during said mechanical finishing such that a napped surface is not produced thereby.

* * * * *

UNITED STATES PATENT AND TRADEMARK OFFICE

CERTIFICATE OF CORRECTION

PATENT NO. : 6,716,775 B1
DATED : April 6, 2004
INVENTOR(S) : Dischler et al.

It is certified that error appears in the above-identified patent and that said Letters Patent is hereby corrected as shown below:

Column 18,
Line 37, insert -- fabric -- before "comprising"

Signed and Sealed this

Seventh Day of September, 2004

JON W. DUDAS
*Director of the United States Patent and Trademark Office*